United States Patent [19]

Egan et al.

[11] Patent Number: 4,512,299

[45] Date of Patent: Apr. 23, 1985

[54] AUTOMOTIVE ENGINE WITH IMPROVED MULTIFILTER LUBRICATION SYSTEM

[75] Inventors: John J. Egan, Wheaton; Andrew B. Witkowski, Oakbrook Terrace, both of Ill.

[73] Assignee: International Harvester Company, Chicago, Ill.

[21] Appl. No.: 560,762

[22] Filed: Dec. 12, 1983

[51] Int. Cl.[3] ..... F01M 1/00

[52] U.S. Cl. ..... 123/196 A; 123/196 AB; 210/168; 184/6.21; 184/6.24

[58] Field of Search ..... 123/196 R, 196 A, 196 AB; 210/168; 184/6.21, 6.24

[56] References Cited

U.S. PATENT DOCUMENTS

| | | | |
|---|---|---|---|
| 2,302,552 | 11/1942 | Johnson | 123/196 A |
| 2,425,700 | 8/1947 | Le Clair | 184/6.24 |
| 3,400,785 | 9/1968 | Allen | 184/6.24 |
| 3,741,342 | 6/1973 | Maddalozzo | 184/6.4 |
| 4,174,699 | 11/1979 | Gill | 123/196 A |
| 4,324,213 | 4/1982 | Kasting et al. | 123/196 A |

FOREIGN PATENT DOCUMENTS

| | | | |
|---|---|---|---|
| 565105 | 10/1958 | Canada | 184/6.24 |
| 820878 | 9/1959 | United Kingdom | 184/6.24 |

*Primary Examiner*—E. Rollins Cross

*Attorney, Agent, or Firm*—Ernest E. Helms; F. David AuBuchon

[57] ABSTRACT

An automotive engine is provided with an improved multifilter oil lubrication system. At least two filters are provided wherein the majority of the oil flow is through a primary coarse filter. At least one fine secondary filter is provided to filter the oil not going to the coarse filter. The oil from the fine filter is delivered directly to the engine. The improved system may be used with a smaller pump using less horsepower than previously possible by multifilter bypass systems. The addition of the fine filtration increases engine life.

19 Claims, 1 Drawing Figure

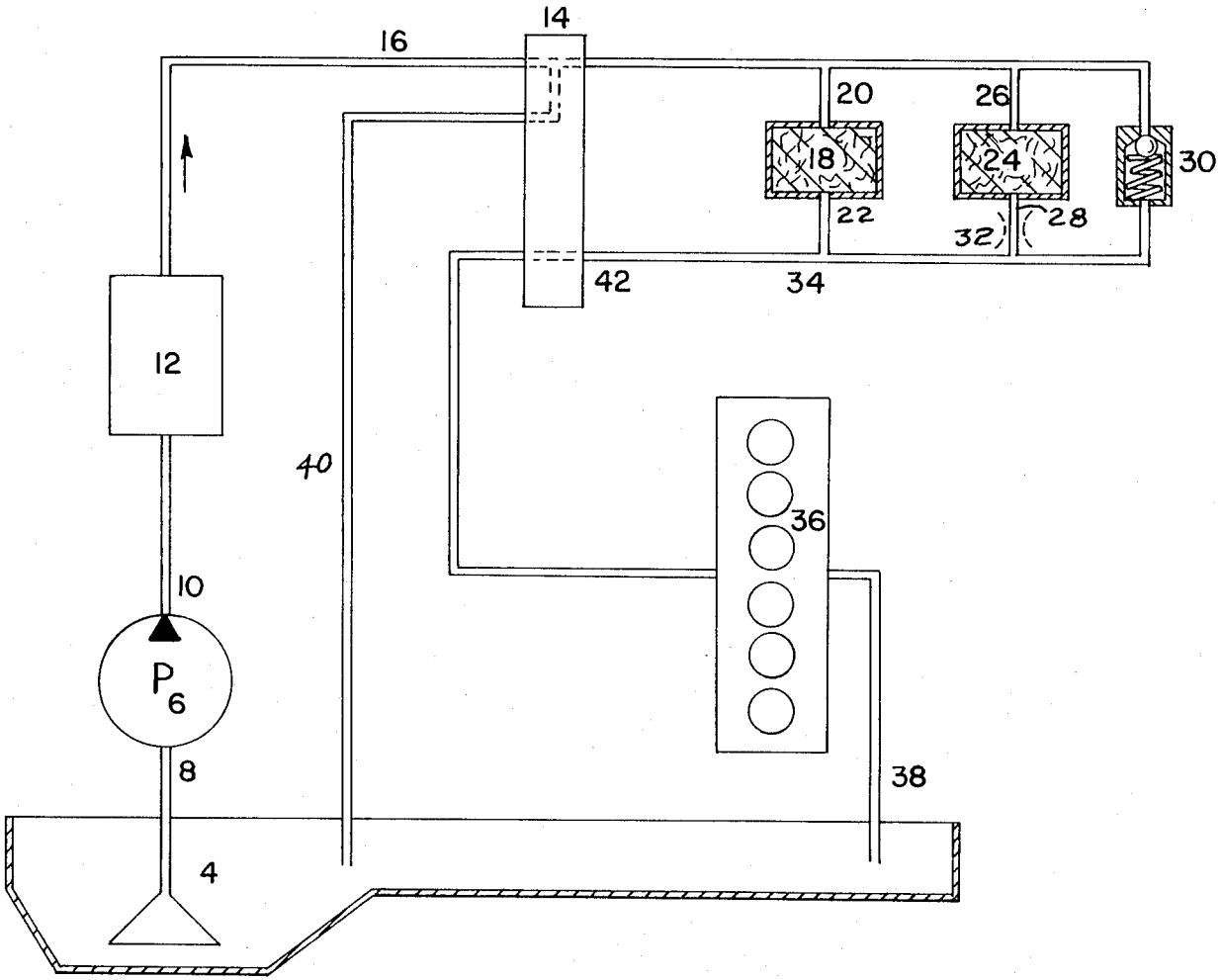
30
28
26
24
32
20
22
18
34
42
14
16
12
10
P
6
8
4
40
36
38

AUTOMOTIVE ENGINE WITH IMPROVED MULTIFILTER LUBRICATION SYSTEM

BACKGROUND OF THE INVENTION

An automotive engine is provided with an improved multifilter oil lubrication system. At least two filters are provided wherein the majority of the oil flow is through a coarse filter. At least one fine filter is provided to filter the oil not going to the coarse filter. The oil from the fine filter is delivered to the engine, thereby increasing engine life. The improved system may be used with a smaller oil pump using less horsepower than previously possible by multiflter bypass systems.

DISCLOSURE OF PATENT ART

Oil contamination is a major factor to automotive engine life. To reduce the wear of mating surfaces (i.e., piston ring, bearings etc.) the oil sump contamination must be kept at minimum levels.

Oil contaminants (i.e., dust, dirt, foreign particles) appears in various particle sizes. The particle size of oil contaminant that an oil filter can remove is a function of the oil filters filtering media.

In single filter oil systems the lower limit of oil contaminant particle size captured by the filter is a function of the filter media. In many automotive engines, especially diesels it is desirable to further filter the oil to remove the fine particles which are not removed by the single or primary filter.

To accomplish the above multifilter bypass oil lubrication systems have been developed. An example of a multifilter bypass system is Kasting et al. U.S. Pat. No. 4,324,213. Kasting et al. has a main flow filter and a bypass filter. The main flow filter receives the majority of oil flow from the oil pump and filters out the larger size particles. The bypass filter can be designed to provide a finer degree of filtering since the bypass filter operates at a lower volumetric flow rate. All of the oil leaving the bypass filter returns to the oil pan (sump).

SUMMARY OF THE INVENTION

A major feature of the present invention is that the fine secondary filter delivers the clean oil directly to the engine in parallel with the full flow primary filter. In this manner the system utilizes all the oil output from the pump allowing a smaller capacity pump in the engine requiring less horsepower to operate.

The majority of the oil flow typically 65–90 percent, is filtered through the full flow primary filter in order that large particle size debris, which are most harmfull, be strained out. The balance of the flow is diverted through the fine secondary filter, which is a high efficiency filter taking out very small particle size dust, dirt or any other foreign matter in the oil.

One advantage of the present invention is that all the oil is delivered to the engine, very efficiently filtered. Since the oil from the secondary filter is delivered to the engine and not the oil sump the present invention requires a lower oil flow rate, thereby allowing the use of a smaller pump with less horsepower consumption.

It is an object of the present invention to provide a oil lubrication system adaptable for automotive engines, especially diesels, which reduces oil sump contaminant levels. It is another object of the present invention to provide an automotive engine with an improved filtering capacity of the filter system while keeping the pressure resistance load at a minimum. It is yet another object of the present invention to provide a oil lubrication system adaptable for automotive engines capable of increasing filtering capacity without decreasing the service life of the filters. It is yet still another object of the present invention to provide a engine lubrication system wherein the oil emanating from the fine filter is fed directly into the engine and is not fed into the oil sump.

Still other and more specific objects of the present invention may be appreciated by consideration of the following drawing and detailed description.

DETAILED DESCRIPTION OF THE DRAWING

FIG. 1 is a schematic of an automotive engine with one embodiment of the lube oil system of the present invention. The engine has four main components, the oil pump 6, the primary filter 18, the secondary filter 24 and the engine block 36.

In operation oil is stored in the oil system and sump 4. Oil from sump 4 enters pump 6 through pump inlet 8. Pump 6 supplies a 24 Gallons Per Minute (G.P.M.) flow of pressurized oil at approximately 75 Pounds Per Square Inch Gage (P.S.I.G.) for the lubrication through pump outlet port 10. The embodiment of FIG. 1 has one outlet port 10 which eventually feeds into the first header 16, however, it is apparent to those skilled in the art that the present invention could provide for an outlet 10 which supplies primary filter 18 directly and a second outlet to provide a second part of the pressurized oil flow directly to secondary filter 24. Oil cooler 12 fluidly communicates with pump outlet port 10 to remove accumulated heat from the oil. Oil cooler 12 also fluidly communicates with the first header 16.

First header 16 with oil pressure 65 P.S.I.G. fluidly communicates with the pump 6 thorugh oil cooler 12 and with primary and secondary filters 18 and 24 respectively. A pressure drop of approximately 10 P.S.I.G. occurs in first header 16 over pressure regulating valve 14. Primary filter 18 will receive the first part (20 G.P.M.) of the pressurized oil flow through its inlet port 20 at approximately 55 P.S.I.G. and this first part will always be more than the second part of the pressurized oil flow which flows through the secondary filter 24. At least one secondary oil filter 24 fluidly communicates with the first header 16 through its inlet port 26. Secondary filter 24 fluidly communicates with the second header 34 through its outlet port 28. For most applications, simplicity of design wil mandate only one primary filter 18. The secondary filter 24 receives a second part (4 G.P.M.) of pressurized oil flow and also has a much finer filtering media which has a lower micron rating than the filtering media of the primary filter. The above dual filtering arrangement allows most of the oil to go through the primary filter but improves the system by allowing a selected portion of the oil to go through a much finer filter thereby further increasing the purity of the oil supplied to the engine block 36.

In some embodiments it may be desirable to decrease or adjust the second part of the pressurized oil flow going through secondary oil filter 24. To accomplish the above the embodiment of FIG. 1 is supplied with a restrictor valve 32 or an orifice to further restrict the oil flow through secondary oil filter 24 by increasing fluid resistance. Depending upon design requirments, the restrictor valve 32 may fluidly communicate with the inlet port 26 or outlet port 28 of the secondary filter 24.

Second header 34 fluidly communicates with primary and secondary filter outlet ports 22 and 28 respectively and engine block 36. In the industry the second header 34 is sometimes referred to as the oil gallery. Upon entery into block engine 36 the oil enters means for internally passing the oil flow through the engine block (not shown) which usually consists of small passageways which lubricate the various moving parts of the engine blocks like pistons and crankshafts. The oil then departs from the engine block 36 and is dumped into the sump 4.

The embodiment illustrated in FIG. 1 also has a feature of a bypass valve 30. Bypass valve 30 has two specific functions. The first function of filter bypass valve 30 is to provide fluid communication between the first header 16 and the second header 34 during cold starts. During cold starts the pressure differential between the first header 16 and second header 34 can reach an excessive level which can damage the primary 18 and secondary 24 filters. Filter bypass valve 30 also fluidly communicates with the first and second headers 16,34 whenever the primary 18 or secondary 24 filters become so clogged as to cause a pressure drop which makes the pressure level in the second header 34 too low for proper engine operation. As illustrated in FIG. 1 filter bypass valve 30 is set for a pressure differential of 20 PSI.

The embodiment of FIG. 1 also has a pressure regulating valve 14 for regulating the oil pressure in the second header 34 at 50 PSIG. Pressure regulating valve 14 is capable of fluidly communicating with the oil sump 4 through line 40. To regulate the pressure in the second header 34 at 50 PSIG there is provided a sensing port 42 which signals the pressure in second header 34 to regulate valve 14. Pressure regulating valve 14 selectively communicates with the first header 16 at 65 PSI and the sump 4 to divert a portion of the flow emanating from pump 6 to regulate the pressure in second header 34.

While the working of the present invention have been explained in the embodiment illustrated in FIG. 1, it will be apparent to those skilled in the art of the various modifications which can be made without departing from the spirit or scope of the present invention as encompassed by the claims.

What is claimed is:

1. An automotive internal combustion engine with an oil lubrication system comprising:

an oil pump for delivering a pressurized oil flow through said oil lubrication system;

at least one primary oil filter having an inlet port which fluidly communicates with a first part of the pressurized oil flow, said primary oil filter having a first micron rating, and said primary oil filter having an outlet port;

at least one secondary oil filter having an inlet port which fluidly communicates with said second part of the pressurized oil flow, said second part of the pressurized oil flow being less than said first part of the pressurized oil flow, said secondary oil filter having a second micron rating, said second micron rating being lower than said first micron rating, and said secondary oil filter having an outlet port;

means for restricting the second part of the pressurized oil flow through said secondary filter;

an engine block which fluidly communicates with said outlet ports of said primary and secondary oil filters.

2. An apparatus as recited in claim 1 wherein said automotive internal combustion engine is a diesel.

3. An apparatus as recited in claim 1 wherein the oil pump delivers said first and second oil flow to a first header which fluidly communicates with said primary oil filter inlet port and said secondary filter inlet port.

4. An apparatus as recited in claim 1, wherein said primary oil filter outlet port and said secondary oil filter outlet port fluidly communicate with a second oil header.

5. An apparatus as recited in claim 3, wherein said primary oil filter outlet port and said secondary oil filter outlet port fluidly communicate with a second oil header.

6. An apparatus as recited in claim 1 wherein an oil cooler fluidly communicates with said oil pump and said primary oil filter.

7. An apparatus as recited in claim 1 wherein an oil cooler fluidly communicates with said oil pump and at least one of said secondary oil filters.

8. An apparatus as recited in claim 1 wherein an oil sump fluidly communicates with said engine block and with said oil pump.

9. An apparatus as recited in claim 5 wherein a filter bypass valve fluidly communicates with said first and second headers when the pressure differential between said first and second headers reaches a predetermined value.

10. An apparatus as recited in claim 1 wherein a restrictor valve fluidly communicates with said secondary filter.

11. An apparatus as recited in claim 1 wherein said means for ristricting the second part of the pressurized oil flow is an orifice which fluidly communicates with said secondary filter inlet.

12. An apparatus as recited in claim 1 wherein said means for ristricting the second part of the pressurized oil flow is an orifice which fluidly communicates with said secondary filter outlet.

13. An automotive internal combustion engine with an oil lubrication system comprising:

an oil pump for delivering a pressurized oil flow through said oil lubrication system;

a first header for receiving the pressurized oil flow from said oil pump;

a primary oil filter having an inlet port which fluidly communicates with said first header to receive a first part of the pressurized oil flow, said primary oil filter having a first micron rating, and said primary oil filter having an outlet port;

at least one secondary oil filter having an inlet port which fluidly communicates with said first header to receive a second part of the pressurized oil flow, said second part of the pressurized oil flow being less than said first part of the oil flow, said secondary oil filter having a second micron rating, said second micron rating being lower than said first micron rating, and said secondary oil filter having an outlet port;

an orifice which fluidly communicates with said secondary oil filter outlet port for restricting the second part of the oil flow;

a second header which fluidly communicates with said primary filter outlet port and said orifice, and said second header having an outlet port;

a filter bypass valve which fluidly communicates with said first header and said second header, for bypassing the pressurized oil flow from said primary and secondary oil filters when the pressure differential between said first and second headers reaches a predetermined value; and an engine block which fluidly communicates with said second header.

14. An apparatus as recited in claim 13 wherein an oil sump fluidly communicates with said engine block and said oil pump and also there is a pressure regulating valve, said pressure regulating valve selectively fluidly communicates with said first header and said oil sump in response to the pressure level in said second header to maintain the pressure level in said second header at a predetermined value.

15. A diesel engine with an oil lubrication system comprising:

an oil sump;

an oil pump for delivering a pressurized oil flow through said lubrication system, said oil pump having an inlet port which fluidly communicates with said oil sump;

a first oil header which fluidly communicates with said oil pump;

a primary oil filter with an inlet port which fluidly communicates with said first header for a first part of the pressurized oil flow, said primary oil filter having a first micron rating, and said primary oil filter having an outlet port;

a secondary oil filter with an inlet port which fluidly communicates with said first header for a second part of the pressurized oil flow, said second part of the pressurized oil flow being less than said first part of the pressurized flow, said secondary oil filter having a second micron rating, said second micron rating being lower than said first micron rating and said secondary oil filter having an outlet port;

an orifice which fluidly communicates with said secondary oil filter outlet port for restricting the second part of the oil flow;

a second header which fluidly communicates with said outlet port of said primary filter and said orifice;

an engine block with an oil inlet port which communicates with said second header, said engine block having an oil outlet port which fluidly communicates with said oil sump;

a pressure bypass valve which fluidly communicates with said first header and said second header for bypassing the oil flow from said primary and secondary oil filters when the pressure differential between said first and second headers reaches a predetermined value; and a pressure regulating valve which selectively fluidly communicates with said first header and said oil sump in response to the pressure level in said second header to maintain the pressure level in said second header at a predetermined value.

16. An automotive internal combustion engine oil lubrication system comprising:

an oil pump for delivering a pressurized oil flow through said oil lubrication system;

a primary oil filter having an inlet port which fluidly communicates with a first part of the pressurized oil flow, said primary oil filter having a first micron rating, and said primary oil filter having an outlet port;

at least one secondary oil filter having an inlet port which fluidly communicates with a second part of the pressurized oil flow, said second part of the pressurized oil flow being lower than said first part of the pressurized oil flow, said secondary oil filter having a second micron rating, said second micron rating being lower than said first micron rating, and said secondary oil filter having an outlet port;

means for restricting the second part of the pressurized oil flow through said secondary filter;

means for passing a pressurized oil flow internally within an engine, said means for passing a pressurized oil flow internally within an engine fluidly communicates with the outlet ports of said primary and secondary oil filters; and means to fluidly communicate said means for passing an oil flow internally within an engine with said oil pump.

17. An apparatus as recited in claim 16 wherein the automotive internal combustion engine is a diesel.

18. An apparatus as recited in claim 17, wherein said primary oil filter inlet port and said secondary oil filter inlet port fluidly communicate with a first oil header.

19. An apparatus as recited in claim 18 wherein said primary oil filter outlet port and said secondary oil filter outlet port fluidly communicate with a second oil header.

* * * * *